United States Patent [19]

Buckenmayer

[11] 4,014,501

[45] Mar. 29, 1977

[54] CONTAINER FOR AIR TREATING MATERIAL

[75] Inventor: Robert H. Buckenmayer, Stanhope, N.J.

[73] Assignee: Airwick Industries, Inc., Carlstadt, N.J.

[22] Filed: Feb. 24, 1976

[21] Appl. No.: 660,910

[52] U.S. Cl. ..... 239/58; 215/332; 220/366

[51] Int. Cl.[2] ..... A61L 9/00

[58] Field of Search ..... 239/34, 53–60; 220/366, 374; 215/329, 332; 206/.5; 222/187, 519; D23/150; D9/216

[56] References Cited

UNITED STATES PATENTS

| | | | |
|---|---|---|---|
| 2,657,090 | 10/1953 | Meek | 239/59 X |
| 2,765,950 | 10/1956 | Wheeler | 239/58 X |
| 2,797,844 | 7/1957 | Meek | 239/60 X |
| 3,239,145 | 3/1966 | Russo | 239/60 X |
| 3,976,246 | 8/1976 | Hauri et al. | 239/60 X |

FOREIGN PATENTS OR APPLICATIONS

| | | | |
|---|---|---|---|
| 1,374,670 | 8/1964 | France | 239/58 |

*Primary Examiner*—Johnny D. Cherry
*Assistant Examiner*—Andres Kashnikow
*Attorney, Agent, or Firm*—Harry Falber

[57] ABSTRACT

A container for air treating materials comprising a base wherein said air treating material is suspended and an adjustably displaceable cover associated therewith, said base having sidewall segments with openings therebetween and projections extending from the top thereof adapted to engage a plurality of oblique grooves on the inner surface of said cover so as to facilitate the raising of the cover and the corresponding exposure of the openings to allow the diffusion of the air treating material.

11 Claims, 8 Drawing Figures

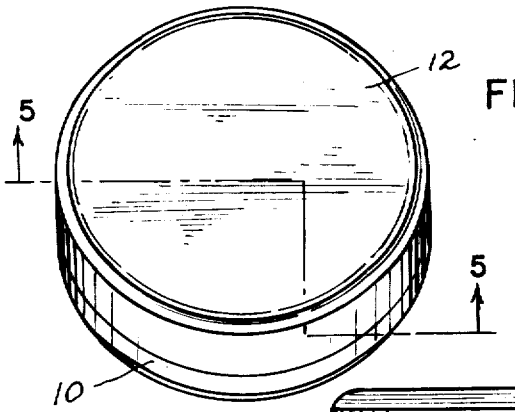
FIG.1
FIG.2
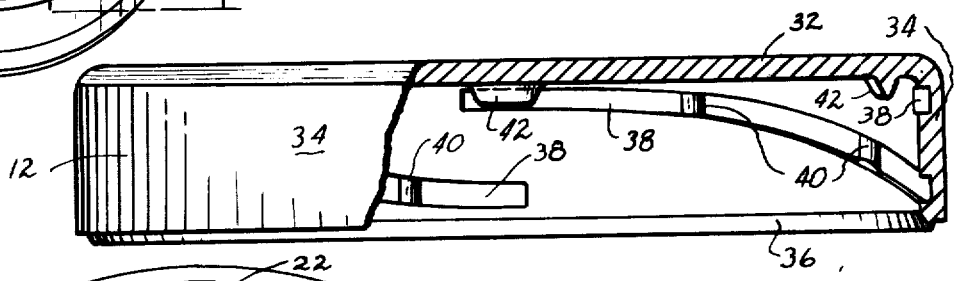
FIG.3
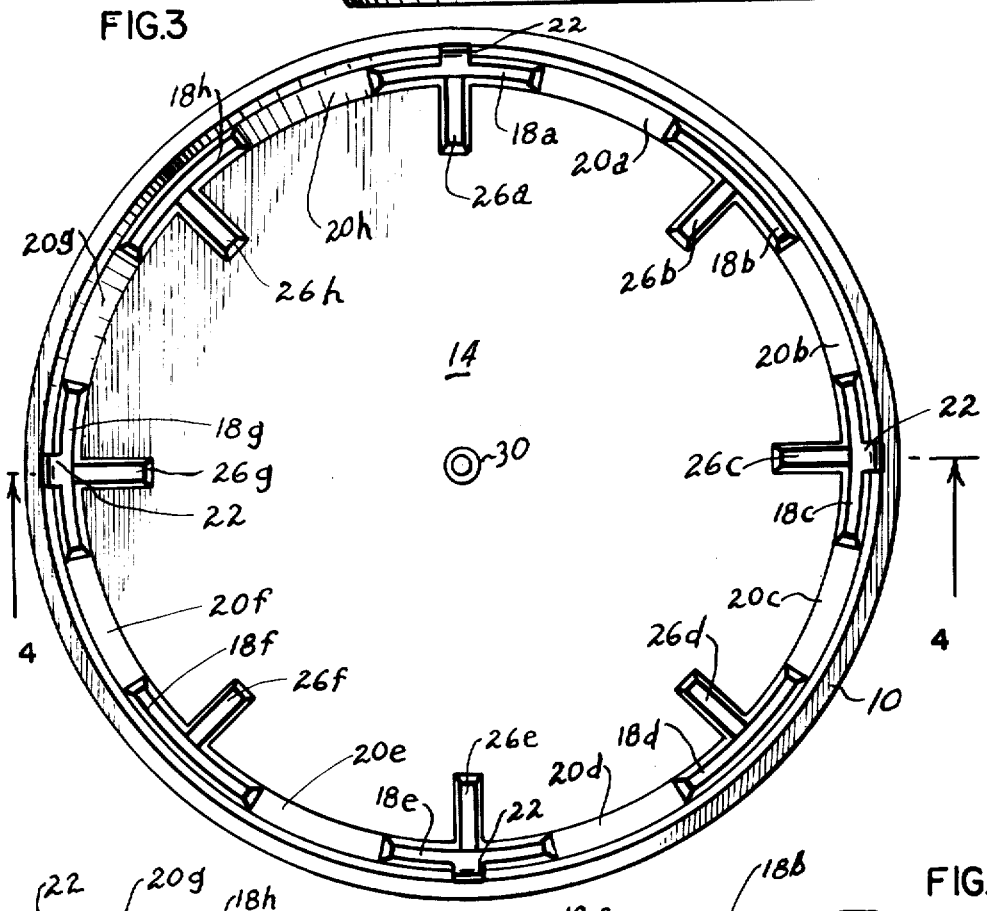
FIG.4
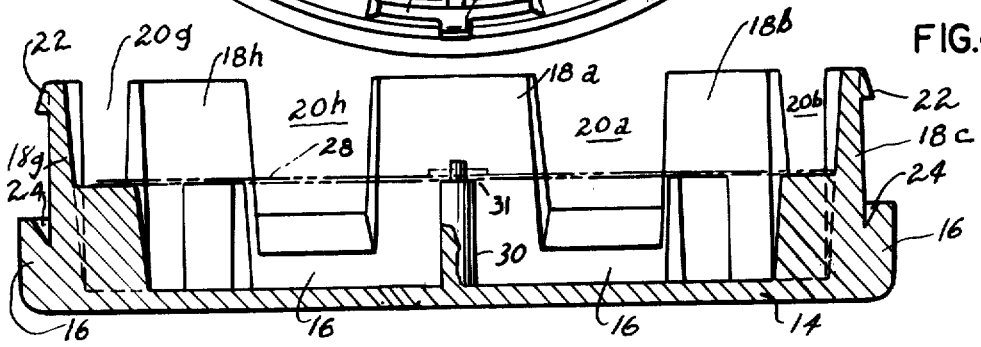

CONTAINER FOR AIR TREATING MATERIAL

Air treating materials provide effective means for gradual introduction into air of volatile air treating components such as air freshening and insecticidal components. In the packaging of these volatile materials for commercial use, it is desirable to utilize dispensers which provide adequate retention of the material, which are attractive and simple in construction and which, most importantly, provide an effective mechanism for controlling and varying the rate of evaporation of the air treating material during use while preventing loss of material during periods of non-use. Typical approaches include raising or lowering of a cover to expose greater or lesser amounts of the material and increasing or decreasing the size of outlet apertures for the same purpose. Typical prior art dispensers are disclosed in U.S. Pat. Nos. 2,657,090; 2,797,844; 2,878,060; 3,104,816; 3,239,145; and 3,804,331.

Thus, the primary object of this invention is to provide a dispenser having an effective mechanism for controlling and varying the rate of emission of the air treating material.

A further object is to provide a dispenser in which the closure means can be readily adjusted vertically and can be readily supported in varying elevated positions relative to the base.

Still a further object is to secure the air treating material in the container in such a position so as to further facilitate control over the rate of evaporization.

Another object is to provide a dispenser which provides substantially all of the other above-noted prerequisites of an acceptable dispenser.

In general, the dispenser of this invention is constituted by a base for housing the air treating material which is provided with sidewall segments and openings therebetween and by a cover for said base having at least one oblique groove on the inner surface thereof. The top of the sidewall segments are provided with projections which engage the grooves and facilitate the rotational and corresponding upward and downward movement of the cover. Optionally, the grooves may be provided with stops spaced along the length thereof such that when said projections contact said stops, the cover is removed from the base by a pre-determined distance corresponding to an exposure of a pre-determined area of the aperture. Support means are provided on the inner surfaces of the sidewall segments for suspending the layer of air treating material. The layer is supported in an elevated position which intersects the apertures, such that proper elevational positioning of the cover can expose either one or both surfaces of the material layer.

In this manner, maximum control of the rate of evaporation of the air treating material is achieved. Likewise, greater efficiency and flexibility of emission is achieved in contrast to many conventional air freshener dispensers wherein emission control is accomplished by a single method of either exposing a greater surface area of the air treating material or increasing the size of inlet and outlet apertures. Thus, control is achieved with the instant dispenser in a dual approach inasmuch as raising the cover a minimum distance provides smaller openings for admitting convection air currents and enables these currents to blow only across the lower surface of the material so as to volatilize lesser amounts of said material. Correspondingly, raising the cover a greater distance allows for an increased air flow through larger openings which then blows across both surfaces of the horizontally suspended layer so as to release greater amounts of material. All sizes of enclosed areas as well as substantially all odor counteractant requirements can thus be properly handled.

Furthermore, the relationship between base and cover allows for ready rotation which is readily translated into efficient lowering and closing of the cover, relative to the base. The optional presence of the stops in the respective grooves allows for the establishment of predetermined relationships regarding the amount of emission as well as for providing stability to the assembly by preventing undesired closing of the cover due to vibrational effects, and the like.

To the accomplishment of the above, and to such other objects as may hereinafter appear, the present invention relates to the construction of a dispenser for air treating material as defined in the appended claims and as described in this specification taken together with the accompanying drawings, in which:

FIG. 1 is a view in perspective of the instant dispenser;

FIG. 2 is an elevational view of the cover with part of the structure broken away and in section;

FIG. 3 is a top plan view of the base;

FIG. 4 is a cross-sectional view of the base taken through line 4—4 of FIG. 3;

Figure 5:
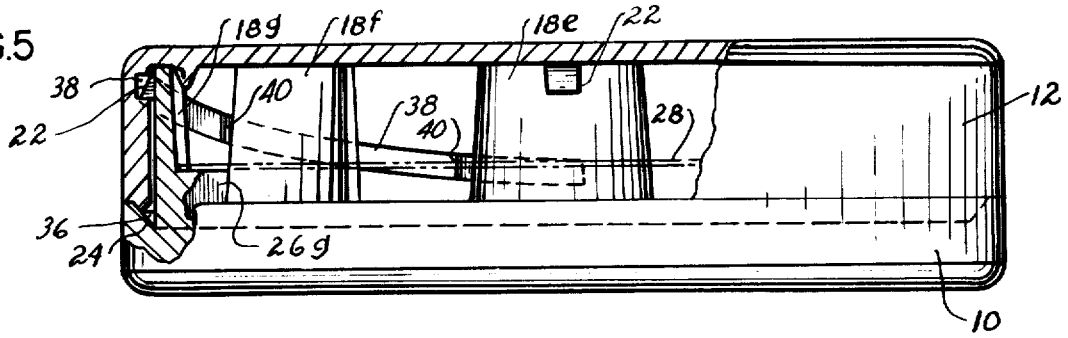
FIG. 5 is a plan view of the instant dispenser containing a partial sectional view taken through line 5—5 of FIG. 1.

As shown in FIGS. 1 and 5 of the drawing, the dispenser comprises a base 10 and a closure or cover 12. Both base 10 and cover 12 will generally comprise a unitary body of molded plastic material. While these parts are preferably fashioned from polyethylene, polypropylene or polyvinyl chloride, it is to be understood that various types of plastics can be employed, and that the parts can be formed from the same or different plastic materials.

As seen in FIGS. 3 and 4, base 10 is provided with a bottom wall 14, an upwardly projecting cylindrical side wall 16 having upper sidewall segments 18*a, b, c, d, e, f, g, h* defining apertures 20*a, b, c, d, e, f, g, h* therebetween. It is apparent that apertures 20*a–h* provide openings in the side wall of base 10 which, when cover 12 is elevated, permit circulation of air through the dispenser and emission of volatilizable material therefrom. Alternate sidewall segments 18*a, c, e, g* contain projections 22 on the top of the exterior surface thereof. The number of projections 22 may vary, although at least two are generally required for effective and stable rotational operation of cover 12. When the number of grooves exceeds two, it is preferred to utilize one projection 22 for every groove present in cover 12. Sidewall 16 is provided with recess 24 on the periphery thereof in order to engage cover 12 in a sealed arrangement so as to eliminate undesired evaporation of the active air treating material.

The inner surfaces of sidewall segments 18*a–h* are provided with support members 26*a, b, c, d, e, f, g, h* which serve to suspend a layer 28 of air treating material. The number of support members 26*a–h* may also vary, although four or more will generally be utilized to provide sufficient stability to the air treating material layer 28. The height of support members 26*a–h* will be so established that layer 28 present thereon will intersect apertures 20*a–h* and be visible therethrough. It is also essential that layer 28 be positioned between the bottom and top boundaries of apertures 20*a–h* and not on a level with either. Optionally, noted in FIG. 4, a post 30 may be centrally located on bottom wall 14 in order to provide additional support for layer 28. Post 30 may comprise a lower section and an upper section of reduced diameter such that a seat 31 is formed at the intersection of said sections and at a height equal to the height of support members 26*a–h*. Alternately, support members 26*a–h* may contain upwardly extending, tapered, support wedges (not shown) in order to secure layer 28 more firmly in position. Thus, where only support members 26*a–h* are present, layer 28 will require a diameter slightly larger than the distance between opposing sidewall segments, e.g. 18*a*, 18*e*, such that layer 28 will be wedged in position between opposing sidewall segments 18*a–h*. Post 30 is provided where, for example, additional support is required to eliminate buckling in the center of layer 28, and the like. Thus, layer 28 is provided with a hole in the center thereof which enables layer 28 to be placed on post 30 and be supported by support members 26*a–h* and seat 31. Layer 28 may, thereafter, be fixed in place by providing the upper section of post 30 with a locking mechanism or, preferably, by heating said upper section to form a molten button which extends beyond the periphery of the hole of layer 28 and thereafter cooling said button. In this manner, layer 28 is fixedly supported between seat 31 and said button. Alternately, a layer 28 with a small diameter may be utilized when support wedges are present inasmuch as layer 28 will now be wedged against these members and affirmatively held in place. It should also be noted that support members 26*a–h* need not be affixed to the inner surfaces of segments 18*a–h* but may be free standing in the interior section defined by said segments 18*a–h*.

As seen in FIG. 2, cover 12 is provided with a top wall 32 and a cylindrical side wall 34 terminating in an inwardly tapered wall section 36. When the dispenser is a closed configuration, wall section 36 engages recess 24 to provide a complete seal between base 10 and cover 12. The interior surface of side wall 34 is provided with at least one, and preferably a plurality of oblique grooves 38. The number, length and angular relationship of grooves 38 may vary depending, in large part, on the dimensions of cover 12. Thus, these variables should be selected keeping in mind the desirability of fully exposing apertures 20*a–h* without the need for a substantial number of complete rotations and the necessity for having a slope for the groove which facilitates retention of a desired opening of apertures 20*a–h* without encouraging slippage. Generally, four equally-spaced grooves 38 of identical configuration will provide the appropriate dimensions and angles so as to facilitate an efficient rotational relationship. Where a single groove 38 is contemplated, it will be necessary to sequentially stagger the height of projections 22 in order to convert the rotational movement into a vertical movement.

Figure 6:
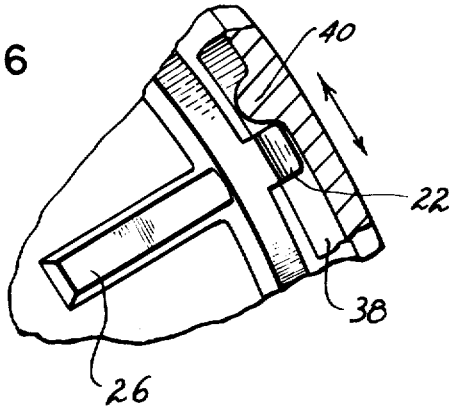
FIG. 6 is a partial sectional view depicting the contact between a sidewall projection and a stop in the groove.

Although projections 22 operating in grooves 38 will generally maintain cover 12 in a stationary position so as to achieve a fixed opening of apertures 20*a–h*, vibration or other such movement may alter the relationship. Accordingly, at least one stop 40, and preferably a plurality of stops 40, may be spaced along grooves 38 for the dual purposes of preventing slippage as well as of providing indicia for establishing pre-determined aperture openings. Thus, stops 40 may be spaced so that when projections 22 encounter a first stop closest to the upper end of groove 38, an opening of established area will be achieved. The size of the opening will increase a pre-determined amount until the next stop is encountered. Accordingly, each stop 40 can be equated to a specific area of exposed aperture 20. Correspondingly, stops 40 will limit the amount of slippage of cover 12, thereby minimizing the amount of undesired change in the size of the aperture opening. Stops 40 may comprise raised areas or nubs, as seen in FIG. 6, or may comprise identations on the surface of grooves 38. It should be noted that stops 40 need not be present in all grooves 38 but should appear in at least two opposing grooves 38 for proper detent action. The practitioner can best determine the number of stops and the spacing distances suited for any particular application.

The dispenser of this invention may include other optional features. For example, FIG. 4 illustrates the presence of tapered surfaces on projection 22. These tapered surfaces together with the resilience of sidewall segments 18*a–h*, enable cover 12 to be receivingly engaged by base 10 merely by exerting pressure thereon. Thus, wall section 36 contacts the tapered surfaces and the exerted pressure results in the inward movement of segments 18*a–h* enabling projections 22 to enter grooves 38 for an engaging relationship between base 10 and cover 12. Such an approach is independent of the relative positioning of base 10 and cover 12 at the moment of compression. It also eliminates the need for entry openings on wall segment 36 and the possibility of the inadvertent separation of base 10 and cover 12. A further option is to have a rod centrally located on the interior of bottom wall 32 of cover 12 to serve as a retaining member for air treating layer 28 when the dispenser is in a closed configuration. Thus, the dispenser may be moved, inverted, rotated, and the like, without dislocation of layer 28. This rod is not present, however, when layer 28 is affixed to post 30. In addition, base 10 may be provided with means for attaching the dispenser to a wall, automobile dashboard and the like, said means including hooks, an opening on the bottom surface thereof, two-sided adhesive tape, and the like.

Still a further optional feature is depicted in FIG. 2. As noted, a plurality of retaining members 42 are positioned on the periphery of the interior of bottom wall 32 of cover 12 and spaced from side wall 34 by a distance approximating the thickness of sidewall segments 18*a–h*. Thus, when the dispenser is in a closed configuration, sidewall segments 18*a–h* are positioned between retaining members 42 and side wall 34 and held tightly in place. Accordingly, the possibility of slippage of cover 12 to even slightly expose apertures 20*a–h* and thereby occasion a loss of volatile material is substantially eliminated. In addition, retaining members 42 serve as guides for segments 18*a–h*, thereby preventing distortion of said segments 18*a–h* when the dispenser is in a closed position and preventing the ejection of projections 22 from grooves 38 when excess rotational pressure is exerted on cover 12.

Air treating layer 28 will generally comprise a substrate impregnated and/or coated on both surfaces with a conventional air treating material. The substrate may be paper, cardboard, and the like, or a sponge-type material. It may be impregnated or coated with liquid material such as essential oils, or coated with a layer of polymeric beads containing entrapped fragrance as disclosed in U.S. application Ser. No. 554,850. Likewise layer 28 may be a self-supporting polymeric layer with entrapped air treating material.

Figure 7:
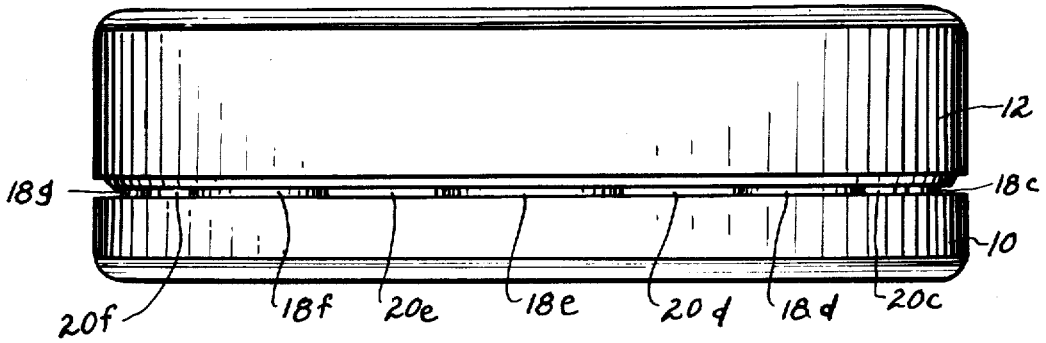
FIG. 7 is an elevational view of the instant dispenser in a first open operative configuration.
Figure 8:
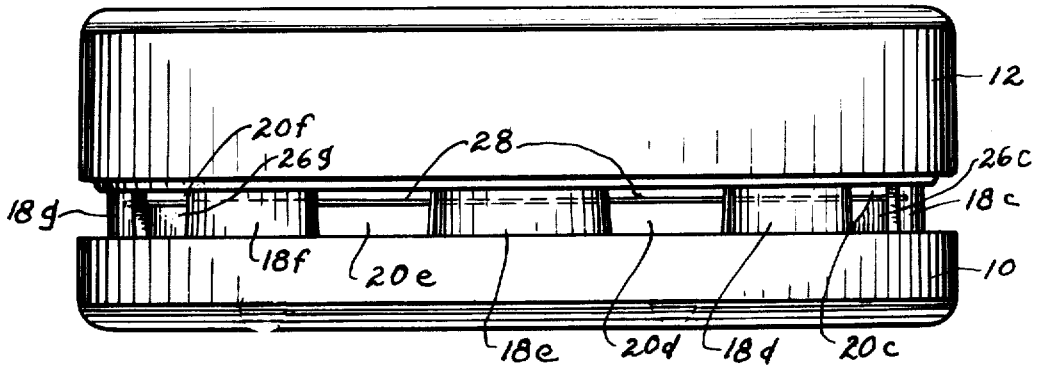
FIG. 8 is an elevational view of the instant dispenser is a second open operative configuration.

More specifically, the operation of the dispenser of this invention involves the separation of base 10 and cover 12 to facilitate positioning of circular air treating layer 28 on support members 26*a–h*. Cover 12 is then placed on the tapered surfaces of projections 22 and pressed in order to engage projections 22 with grooves 38. Closure involves rotating cover 12 until projections 22 encounter the upper end of grooves 38. In this closed position, wall section 36 is seated in recess 24 to prevent evaporation of the air treating material. The rotation to raise cover 12 may be clockwise or counter-clockwise dependng on the slope of grooves 38. For purposes of this discussion and the instant drawings, counter-clockwise rotation of cover 12 is taken to result in a corresponding vertical movement of cover 12. Rotation is continued until projections 22 engage stops 40. Cover 12 is thus raised a pre-determined distance to expose a pre-determined area of apertures 20*a–h* as seen in FIG. 7. This small opening allows for air current to blow solely across the lower surface of the air treating layer 28, providing lesser amounts of air treating material for small enclosed areas and/or for minimum air treating requirements. The exertion of rotational pressure on cover 12 combined with the resiliency of wall segments 18*a–h* allows for projections 22 to clear the first stop and continue until encountering a second stop. As seen in FIG. 8, cover 12 is now raised a greater distance so as to expose a larger area of apertures 20*a–h*. In this instance, layer 28 is obvious through apertures 20*a–h* ad is thus exposed to air currents such that these currents will blow across both surfaces of said layer 28 and effect an increased release of air treating material. While projections 22 will generally retain cover 12 in this particular position of vertical adjustment, excessive vibration may cause downward rotational movement of cover 12. However, such movement will be limited by the distance traversed by projections 22 in reencountering the first stop (see FIG. 6). Thus, only a minimal change in air treating material release will be experienced. It will be apparent that, in this manner, grooves 38 permit adjustment of cover 12 through a range from a very slight opening (FIG. 7) to a substantially complete opening (FIG. 8), thus giving a wide range of control and providing a dispenser which can be adapted to many changing conditions. Finally, clockwise rotation of cover 12 until projections 22 encounter the upper end of grooves 38 will again seal the dispenser.

It will be recognized that cover 12 and base 10 can be opened and raised, or lowered and sealed, innumerable times before the air treating material is consumed; evaporation progressing only when the dispenser is open and being arrested when the dispenser is closed. The other advantages obtained with the instant dispenser include maximum control and variability of the release rate of the air treating material; dual emission mechanisms, i.e. both by increasing in size the inlet and outlet for the air currents and by exposing an additional surface of air treating material to said currents; an attractive and simple construction; and the like.

Summarizing, it is seen that this invention provides an improved dispenser for air treating materials having a unique air treating material release control system and a unique mechanism for raising the cover to expose the material.

While the invention has now been described in terms of the specific embodiments herein, it should be apparent that variations may be developed without departing from the spirit or scope of the invention.

What is claimed is:

1. A dispenser for volatile materials comprising a base part for said volatile material, said base having a plurality of sidewall segments with apertures therebetween, projections extending from the exterior surface of at least two opposing sidewall segments and support means positioned within the area defined by said sidewall segments for suspending a layer of said volatile material in an elevated position intersecting said apertures; and a cover for said base having at least one oblique groove on the interior of the side wall thereof, said groove engaging said projections facilitating rotation and corresponding raising and lowering of said cover to conceal or partially or totally expose said apertures.

2. The dispenser of claim 1, wherein said layer of said volatile material comprises a solid substrate impregnated or coated on both surfaces thereof with said volatile material.

3. The dispenser of claim 1, wherein a self-supporting layer of volatile material is suspended on said support means.

4. The dispenser of claim 1, wherein at least one stop means is present in said at least one oblique groove, the positive engagement of said stop means and said corresponding projection effecting the support of said cover in an elevated position.

5. The dispenser of claim 4, wherein said cover has at least two opposing oblique grooves and each of said opposing oblique grooves has at least one first stop means positioned, respectively, at the same distance from the upper end of said groove such that when said projections contact said at least one first stop means, the elevation of said cover will be no greater than the distance of elevation of the lower surface of said layer, and at least one second stop means positioned, respectively, at the same distance from the upper end of said groove and at a distance greater than that of said at least one first stop means such that when said projections contact said at least one second stop means, the elevation of said cover will be at least equal to the distance of elevation of the upper surface of said layer.

6. The dispenser of claim 1, wherein said base has an annular recess on the periphery thereof for sealingly receiving the sidewall of said cover when said cover is in a closed position on said base.

7. The dispenser of claim 6, wherein said side wall of said cover terminates in an inwardly tapered wall section which sealingly engages said annular recess.

8. The dispenser of claim 1, wherein said sidewall segments are resilient and said projections are tapered upward to facilitate initial engagement of said base and said cover.

9. The dispenser of claim 1, wherein said support means are affixed to the interior surface of said sidewall segments.

10. The dispenser of claim 9, wherein post means for seating and retaining said layer is centrally positioned in said base.

11. A dispenser for volatile materials comprising a base part for said volatile material, said base having eight resilient sidewall segments with apertures therebetween, upwardly tapered projections extending from the exterior surface of each alternating sidewall segment and support means positioned within the area defined by said sidewall segments for suspending a solid substrate impregnated or coated on both surfaces thereof with said volatile material in an elevated position intersecting said apertures; and, a cover for said base having four equally spaced, identical, oblique grooves on the interior of the side wall thereof and a plurality of stop means in two opposed oblique grooves, said stop means being equally spaced, relative to one another, from the upper ends of the respective opposed grooves;

said grooves engaging said projections facilitating rotation and corresponding raising and lowering of said cover to conceal or partially or totally expose said apertures;

at least one equivalent first stop means in each groove being positioned such that when they are contacted by said projections, the cover will be raised to a maximum height corresponding to the distance of elevation of the lower surface of said layer, and at least one equivalent second stop means in each groove being positioned such that when they are contacted by said projections, the cover will be raised to a height corresponding to at least the distance of elevation of the upper surface of said layer.

* * * * *